US010925382B1

(12) United States Patent
Jones et al.

(10) Patent No.: US 10,925,382 B1
(45) Date of Patent: Feb. 23, 2021

(54) NAP PACK

(71) Applicant: The Clay Wolf Company, LLC, Corinth, MS (US)

(72) Inventors: Gail Newman Jones, Corinth, MS (US); Baelyn Wolfe Jones, Salt Lake City, UT (US); Russell Edward Jones, Corinth, MS (US)

(73) Assignee: The Clay Wolf Company, LLC, Corinth, MS (US)

( * ) Notice: Subject to any disclaimer, the term of this patent is extended or adjusted under 35 U.S.C. 154(b) by 275 days.

(21) Appl. No.: 16/042,509

(22) Filed: Jul. 23, 2018

Related U.S. Application Data

(60) Provisional application No. 62/536,915, filed on Jul. 25, 2017.

(51) Int. Cl.

| | |
|---|---|
| ***A45F 4/08*** | (2006.01) |
| ***A47G 9/08*** | (2006.01) |
| *A45C 9/00* | (2006.01) |

(52) U.S. Cl.
CPC ..... *A45F 4/08* (2013.01); *A47G 9/086* (2013.01); *A45C 2009/007* (2013.01)

(58) Field of Classification Search
CPC ..... A47G 9/08
USPC ..... 5/413 R
See application file for complete search history.

(56) References Cited

U.S. PATENT DOCUMENTS

| | | | | |
|---|---|---|---|---|
| 3,633,227 A * | 1/1972 | Tegeler | ..... | A47G 9/086 5/413 R |
| 3,959,834 A * | 6/1976 | Hunt | ..... | A47G 9/086 5/413 R |
| 2004/0107500 A1* | 6/2004 | Pigg | ..... | A47G 9/086 5/413 R |

* cited by examiner

*Primary Examiner* — Fredrick C Conley
(74) *Attorney, Agent, or Firm* — Workman Nydegger

(57) ABSTRACT

A sleeping apparatus includes a pad section configured to allow a user to lay on the pad section. The pad section includes padding of a predetermined thickness. The sleeping apparatus includes a blanket section coupled lengthwise to one side of the pad section, and configured to fold onto, and substantially cover at least a portion of the user and the pad section. A pocket is permanently coupled to the pad section. The pocket includes an opening. Other portions of the sleeping apparatus are configured to fold into the pocket and be held in the pocket by friction when the opening of the pocket is in a downward position.

20 Claims, 11 Drawing Sheets

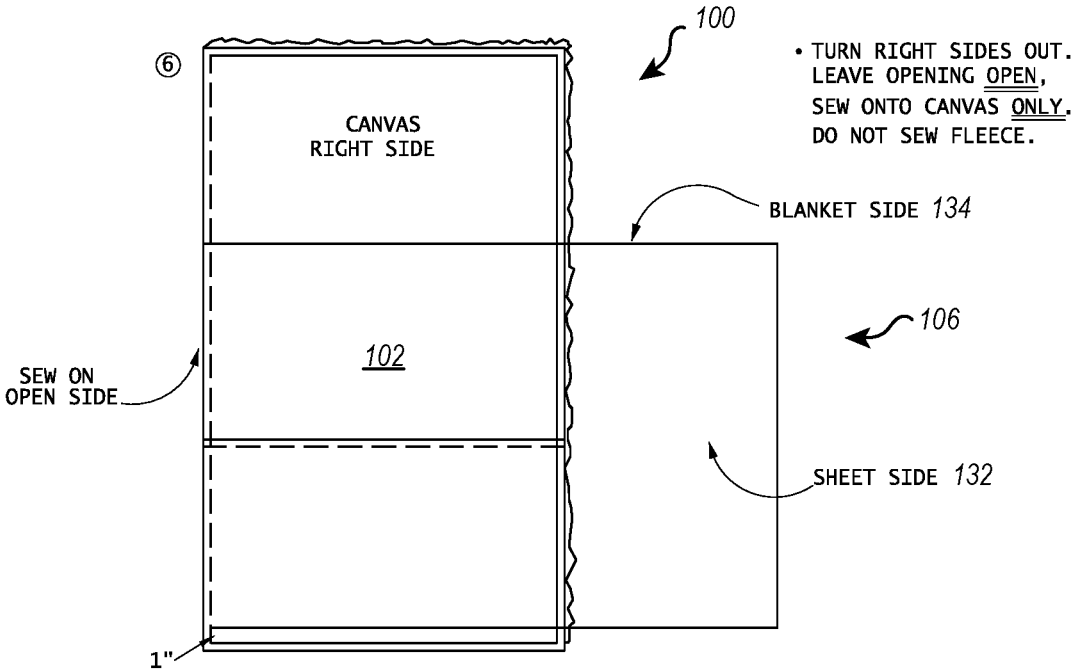

⑦ SEW BLANKET AND SHEET SECTIONS TOGETHER, RIGHT SIDES IN, ON 3 SIDES. TURN TO RIGHT SIDES OUT. THERE WILL BE ONE SIDE WITH RAW EDGES. MATCH RAW EDGES TO RAW EDGES ON MAT SO THAT THE SHEET LAYS NEXT TO THE FLEECE AND NOT THE BLANKET. SEW BLANKET/SHEET 1 INCH FROM BOTTOM (POCKET EDGE, RAW EDGES TOGETHER.

⑧ INSERT LAYER OF BATTING, 6" THICK. SEW BAFFLES AS INDICATED 10.6" APART. ADD ADDITION 6" OF BATTING TO PILLOW.

⑨ FOLD RAW EDGES OVER 1/2" AND SEW FINAL SEAM.

FIG. 4F

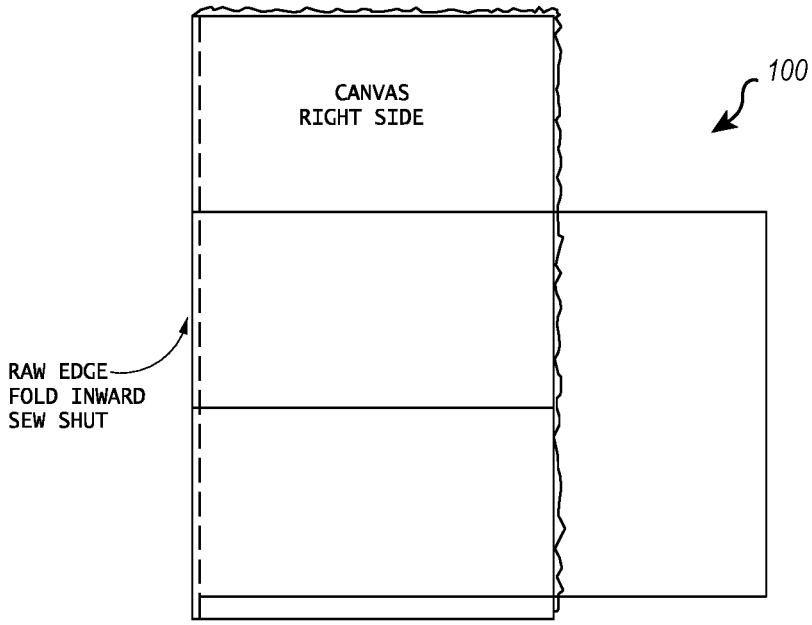

FIG. 4G

NAP PACK

CROSS-REFERENCE TO RELATED APPLICATIONS

This application claims the benefit of U.S. Provisional Patent Application Ser. No. 62/536,915 filed on Jul. 25, 2017, which provisional patent application is incorporated herein by reference in its entirety.

BACKGROUND OF THE INVENTION

Opportunities for varied sleeping arrangements are ubiquitous. For example, sleeping bags used for slumber parties, camping trips, weekends at the grandparents, are readily available and often used. However, when used by children, the elderly, and certain others, sleeping bags may have some disadvantages. For example, storage of a sleeping bag is often done using a so-called stuff sack where a sleeping bag is stuffed into the sack and the sack closed for storage of the sleeping bag. This presents opportunities for the sack to be lost. Alternatively or additionally, surprisingly those with little experience with stuff sacks encounter difficulties in managing the sleeping bag while attempting to stuff it in the stuff sack. This can be especially challenging for children, the elderly, and others.

Sometimes sleeping arrangements can be accomplished by simply using a mat, a separate blanket, and one or more pillows. However, this requires care in ensuring that one or more of the items is not lost to allow for accomplishing comfortable sleep. In another example, daycare centers may have grungy plastic or fabric mats for children to lay on. These are often uncomfortable, resulting in poor sleep, poor circulation, crankiness, and may lead to sickness due to germ transfer as mats are used by different children.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

A sleeping apparatus includes a pad section configured to allow a user to lay on the pad section. The pad section includes padding of a predetermined thickness. The sleeping apparatus includes a blanket section coupled lengthwise to one side of the pad section, and configured to fold onto, and substantially cover at least a portion of the user and the pad section. A pocket is permanently coupled to the pad section. The pocket includes an opening. Other portions of the sleeping apparatus are configured to fold into the pocket and be held in the pocket by friction when the opening of the pocket is in a downward position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which:

FIGS. 4A-4G illustrate various stages of constructing a sleeping apparatus;

DETAILED DESCRIPTION

Embodiments illustrated herein are directed to a so-called Nap Pack™ which is a comfortable, portable sleeping apparatus. The sleeping apparatus is designed to be easy to fold and unfold even by children and the elderly, without assistance from other adults. Additionally, as will be illustrated below, the sleeping apparatus may include functionality for allowing a user to carry and take responsibility for the sleeping apparatus.

As will be illustrated in more detail below, the sleeping apparatus illustrated herein includes an integrated pad section permanently coupled to a blanket section and permanently coupled to a pillow portion. Further, the sleeping apparatus includes an integrated pocket that allows other portions of the sleeping apparatus (e.g., the blanket section, the pad section, and the pillow portion) to be easily folded and placed into the pocket.

Some embodiments are implemented where the pocket has an open end configured to receive various portions of the sleeping mat, where the open end is configured to be in a downward position when the sleeping apparatus is transported. This allows for a handle to be placed in an opposing closed end of the pocket, which opposes the open end of the pocket, for simplicity and to create a secure carrying structure.

Various embodiments of the sleeping apparatus are implemented with sufficient bulk such that the size, shape, and/or materials of various portions of the sleeping apparatus including the size, shape, and/or materials of the pocket, the size, shape, and/or materials of the pad section, the size, shape, and/or materials of the pillow portion, and/or the size, shape, and/or materials of the blanket section are such that the other portions can be placed in the pocket with the open end of the pocket in a downward position, while the remainder of the sleeping apparatus comprises sufficient bulk and heft to create a fiction friction fit between the pocket and the other portions of the sleeping apparatus to prevent the other portions of the sleeping apparatus from falling out of the downward facing open end of the pocket when the sleeping apparatus is transported using the carrying structure.

Using the friction fit, the sleeping apparatus can be constructed with minimal to no external hardware. In particular, while previous sleeping apparatuses have required the use of buckles, straps, fasteners, cordage, clasps, and/or other potentially dangerous hardware, various embodiments of the present invention can be implemented in a fashion that does not require these items. In particular, these items can create choking hazards, strangulation hazards, or other hazards. The embodiments illustrated herein are able to mitigate and/or eliminate many of these hazards by the unique and novel aspects of the invention which allow for eliminating most or all of these items.

Figure 1:
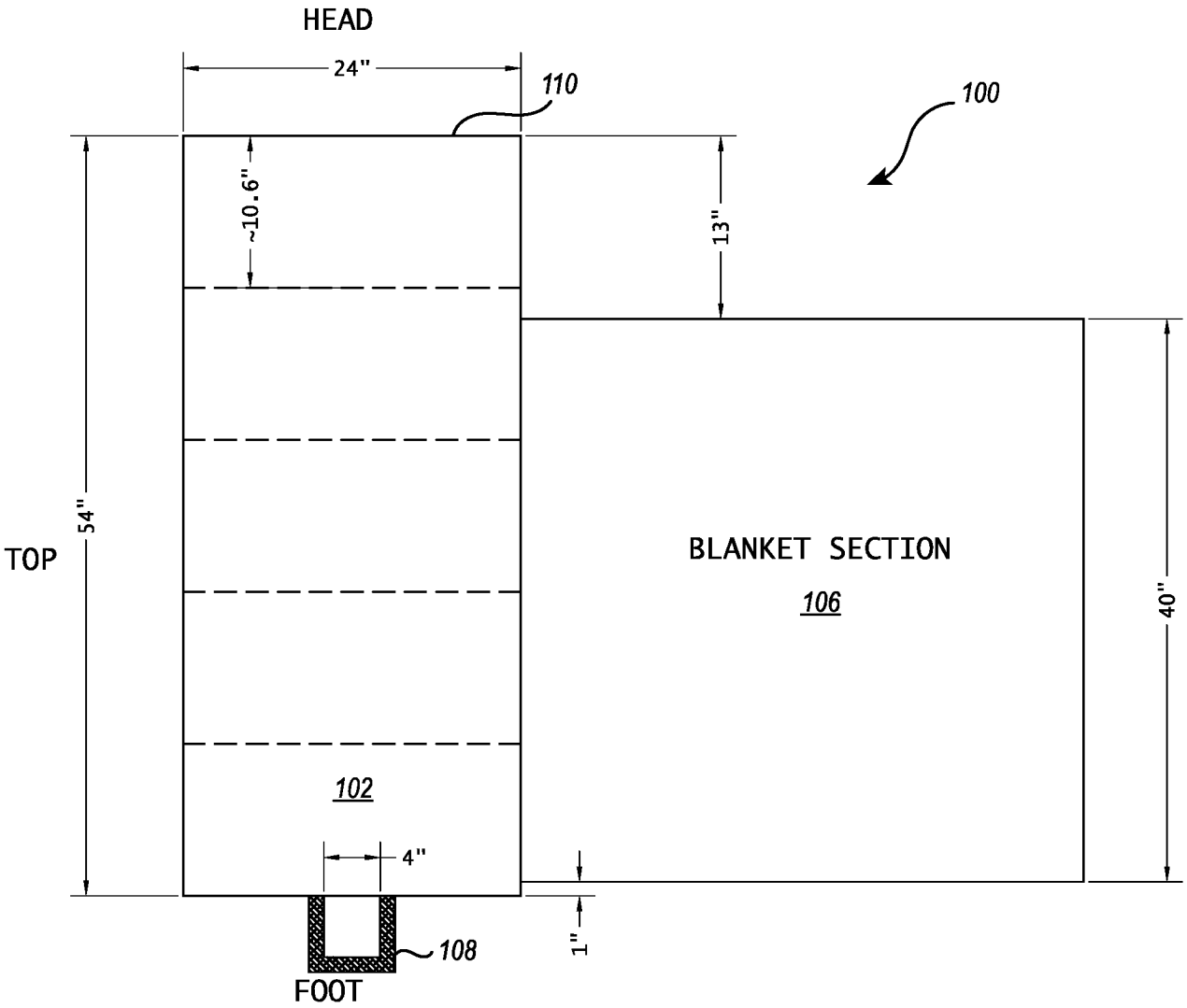
FIG. 1 illustrates a top view of a sleeping apparatus.

Referring now to FIG. 1, the top view of the sleeping apparatus 100 is illustrated. The sleeping apparatus 100 comprises a pad section 102. The pad section 102 comprises a pillow portion 104. The pillow portion 104, in the illustrated example, is simply a portion of the pad section 102 that includes additional padding to create the pillow portion 104. The pad portion 104 includes various baffles as illustrated by the dotted lines in FIG. 1. This allows padding in the pad section 102 to be secured in the pad section 102 such that the padding will not migrate within the pad section 102. This keeps the padding distributed in a fashion that allows for comfortable sleeping. Note that the baffles may be created in some embodiments by stitching across most of, or the entire pad section 102. However, in other embodiments, the baffles may be created by tacking at various points across the pad section 102.

FIG. 1 further illustrates a blanket section 106. In some embodiments, the blanket section 106 is constructed of material similar to that of the pad section 102 but includes less or no fill, such as the padding in the pad section 102. However, in other embodiments, the blanket section may include other fabrics for comfort and/or warmth. This will be discussed in more detail below.

Figure 7:
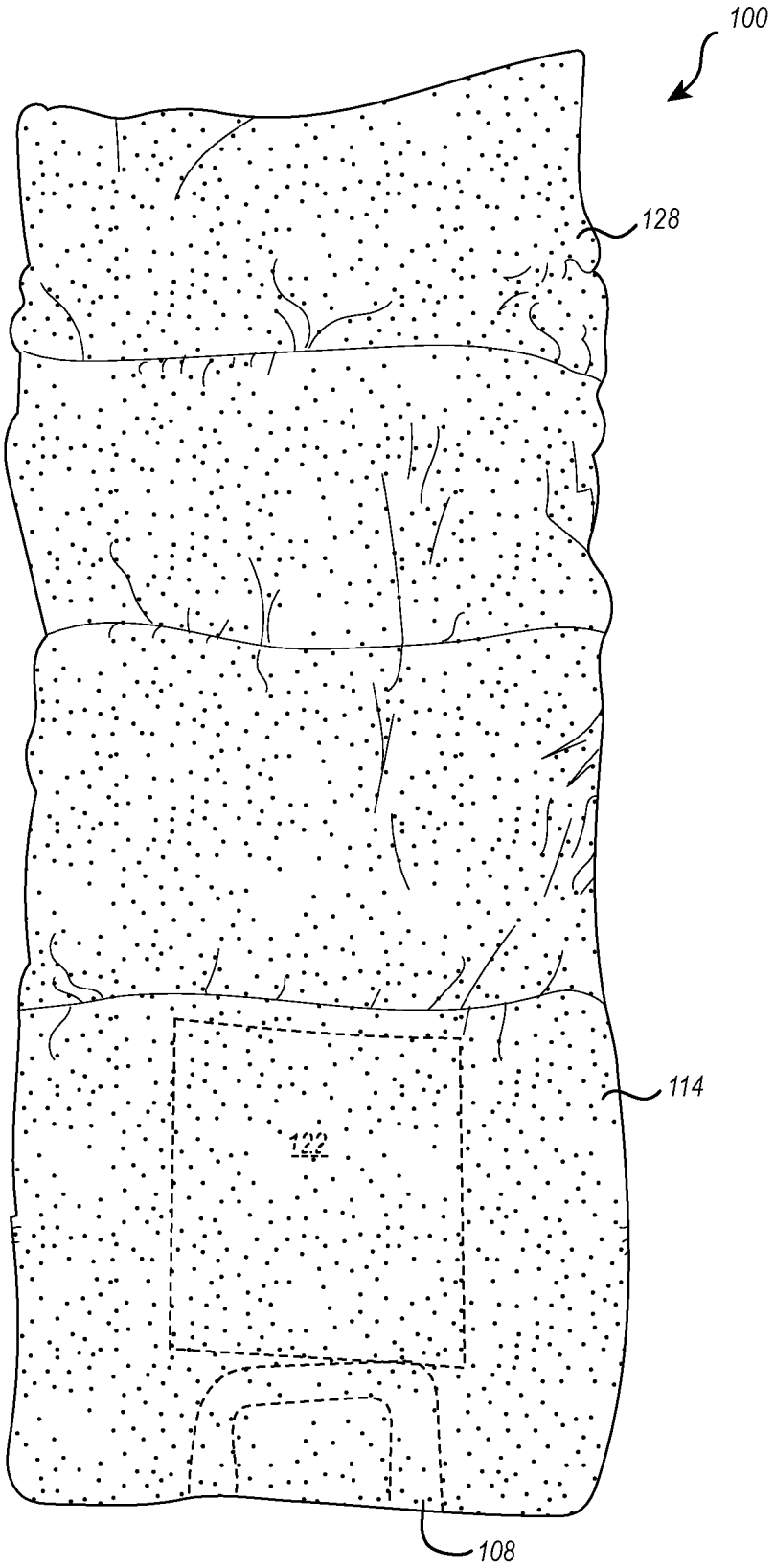
FIG. 7 illustrates a bottom view of a sleeping apparatus in an open position.

FIG. 1 further illustrates a carrying structure 108, which in this case includes a handle. The pad section 102 of the sleeping apparatus 100 includes a head end 110 and a foot end 112 opposite the head end 110. The pillow portion 104 is implemented at the head end 110. The carrying structure 108 is implemented, in the present example, at the foot end 112 of the sleeping apparatus 100. The pocket 114 is also implemented at the foot end of the sleeping apparatus 100. Indeed, when the sleeping apparatus is opened for sleeping, the carrying structure will be folded internally to the pocket 114. An example of this configuration is illustrated in FIG. 7, which shows the pocket 114 folded over the carrying structure 108, such that the carrying structure 108 is internal to the pocket 114 when the sleeping apparatus 100 is configured for sleeping use.

Figure 2:
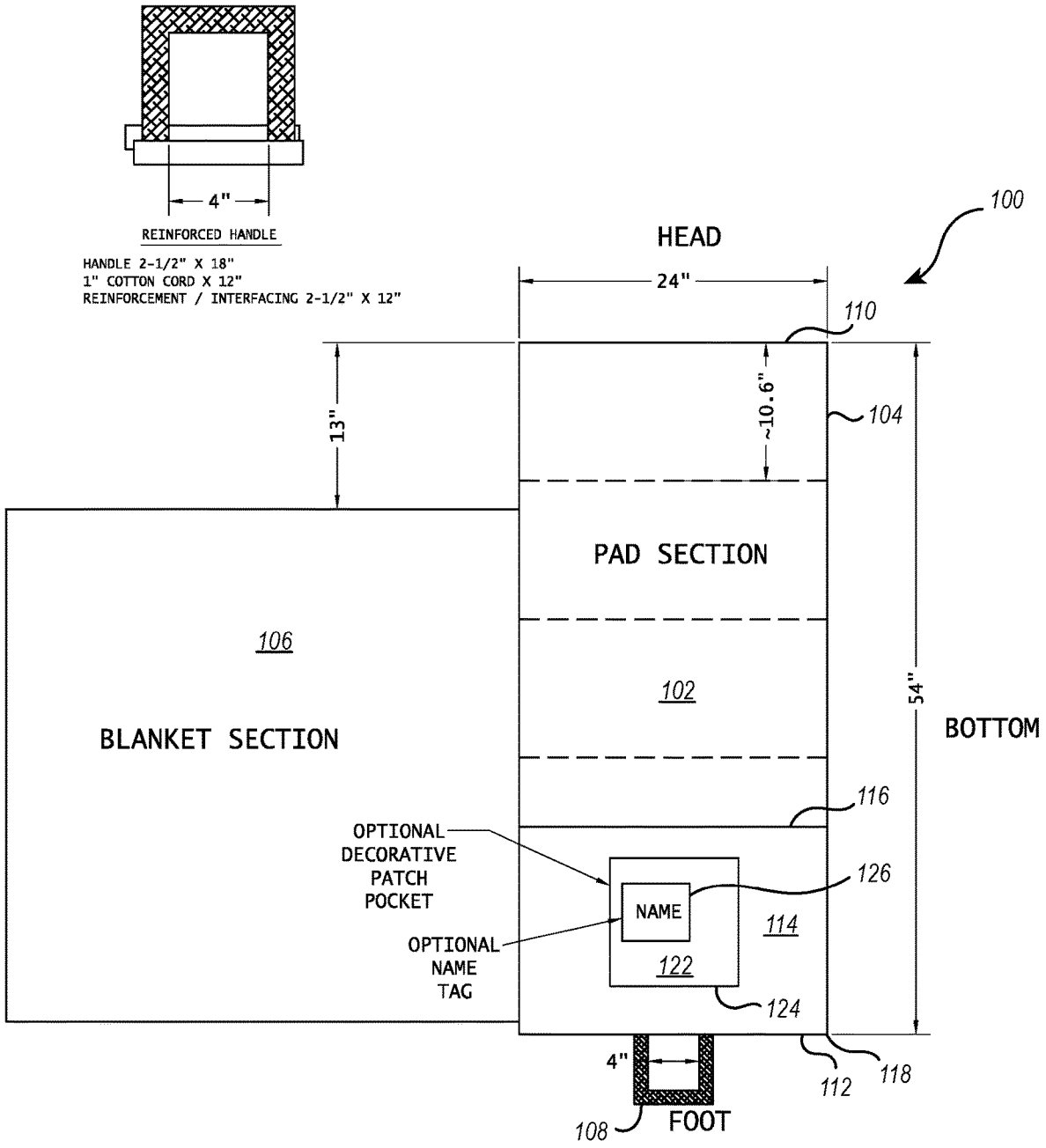
FIG. 2 illustrates a bottom view of a sleeping apparatus.
Figure 3:
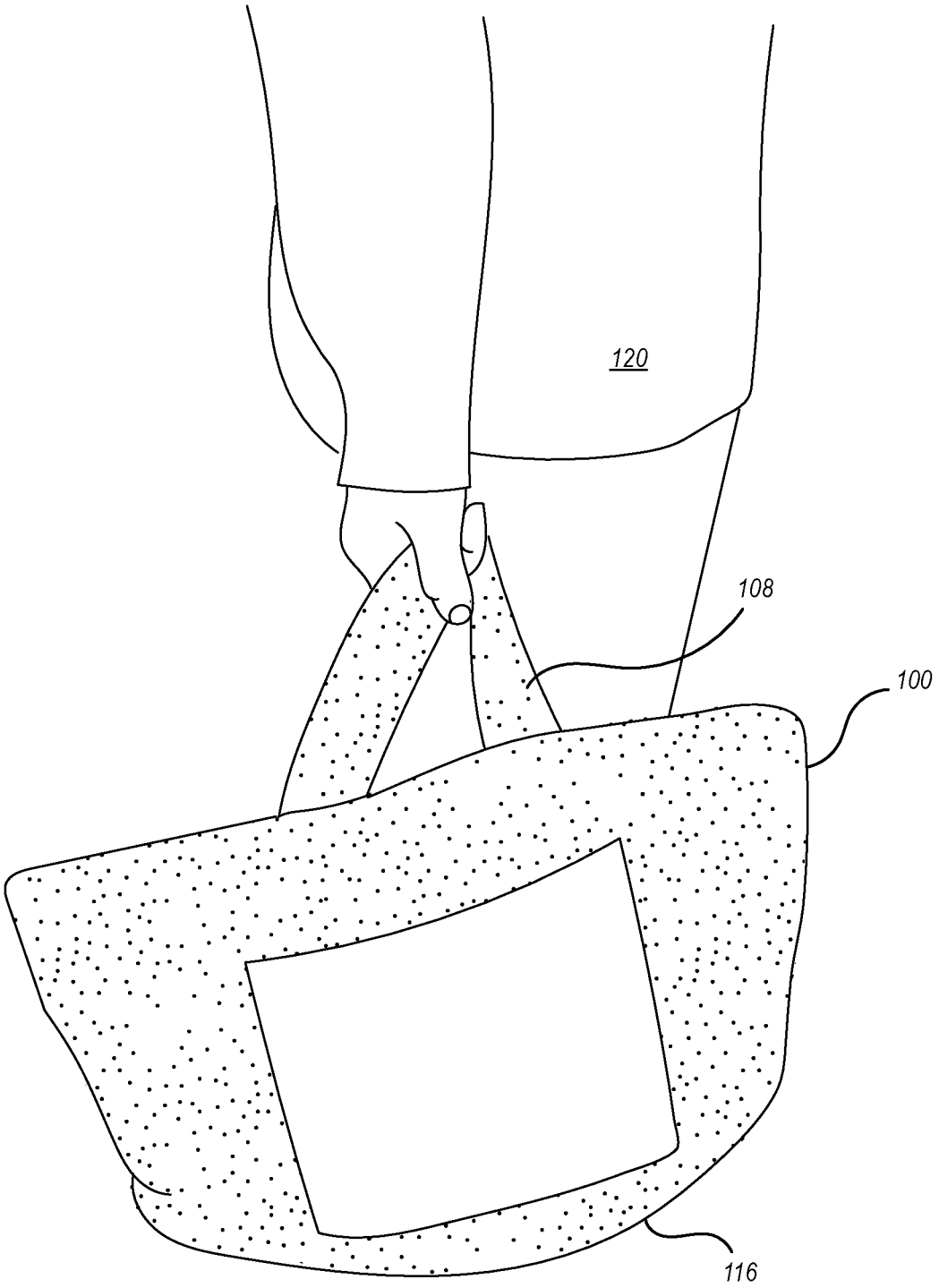
FIG. 3 illustrates a user carrying a sleeping apparatus.

Referring now to FIG. 2, a bottom view of the sleeping apparatus 100 is illustrated. The bottom view helps to illustrate the functionality of the pocket 114. In the illustrated example, the pocket is implemented at the foot end 112 of the sleeping apparatus 100. As will be illustrated in more detail below, the blanket section 106 can be folded onto the top of the pad section 102. Starting at the pillow portion 104, the pad section 102 and the blanket section 106 can be folded towards the pocket 114. As noted previously, the pocket 114 includes an open end 116 and a closed end 118. The pad section 102 along with the pillow portion 104 and the blanket section 106 can be tucked into the pocket 114 through an opening at the open end 116. Once this has been accomplished, the sleeping apparatus 100 can be carried by the carrying structure 108 with the open end 116 pointing downward. An example of this is illustrated in FIG. 3 which shows a user 120 carrying the sleeping apparatus 100 by the carrying structure 108 with the open end 116 pointed in a downward direction.

In particular, the blanket section 106, pad section 102, and pillow portion 104 have sufficient heft and bulk that when rolled (or folded) and placed into the pocket 114 through the open end 116, friction between the pocket 114 and the other portions of the sleeping apparatus 100 is sufficient to keep the pad section 102, pillow portion 104 and blanket section 106 securely in the pocket 114, even when the opening of the pocket 114 is oriented in a downward direction.

Figure 5:
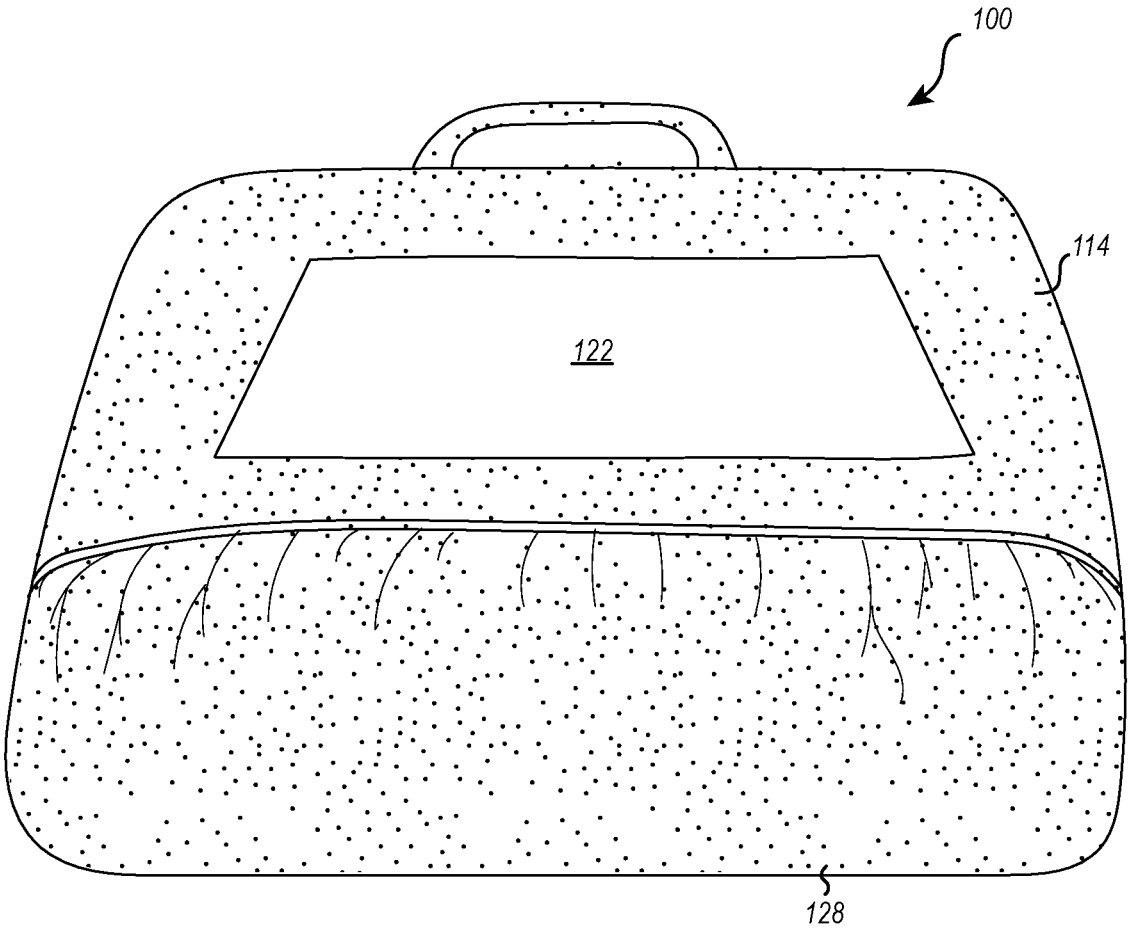
FIG. 5 illustrates a bottom perspective view of a sleeping apparatus in a folded position.

Returning once again to FIG. 2, various additional elements are illustrated that may be optionally implemented on the sleeping apparatus 100. In particular, FIG. 2 illustrates a patch pocket 122 the patch pocket 122 includes an open end 124. This allows for a user to place various items in the patch pocket 122 when transporting the sleeping apparatus 100 as illustrated. In this example, the patch pocket 122 is implemented on the pocket 114. The patch pocket 122 is external to the pocket 114 when closed for transport as illustrated in FIG. 5, but internal to the pocket 114 when the sleeping apparatus is open for use, as illustrated in FIG. 7.

FIG. 2 further illustrates that an optional name patch 126 can be implemented on the sleeping apparatus 100. In this example, the name patch 126 is implemented on the patch pocket 122. However, it should be appreciated that the name patch 124 could be implemented in any (or none) of a number of different locations on the sleeping apparatus 100.

Note that in some embodiments, the patch pocket 122 and/or name patch 124 may be positioned to discourage certain configurations of usage of the sleeping apparatus 100. Additionally, the patch pocket 122 and/or name patch 124 may be of a type of material to discourage certain configurations of usage of the sleeping apparatus 100. In particular, the example illustrated in FIG. 2 illustrates that the patch pocket 122 and the name patch 124 are on the bottom of the sleeping apparatus 100, internal to the pocket (see FIG. 7) when configured for sleeping. The patch pocket 122 and name patch 124 may be positioned and may be of a material that makes them slightly uncomfortable to a user to sleep on if not covered by the padding the pad section 102. Thus, the user will sleep on the sleeping apparatus 100 with the bottom side down such that the user sleeps on the sleeping apparatus 100 in the configuration illustrated in FIG. 6 on the top of the sleeping apparatus 100, rather than the bottom of the sleeping apparatus 100. This will prevent the user from becoming entangled in the open end 116 of the pocket 114.

FIG. 1 and FIG. 2 illustrate various dimensions in which the sleeping apparatus 100 could be implemented. However, it should be appreciated that the sleeping apparatus could be implemented in other configurations for differently sized users. One item of note, in the example illustrated in FIGS. 1 and 2, the blanket section 106 is wider than the pad section 102. This allows for a user, who is not two-dimensional, to be able to completely cover themselves in an appropriate sleeping position. In particular, in the example illustrated, the blanket section 106 is approximately 50% larger in width than the pad section 102. This allows for the user to be covered while still allowing for natural movement that occurs throughout the night.

Note that in some embodiments, the blanket section 106 is intentionally configured to only couple to the pad section 100 along one edge and to purposely exclude any kind of fastening to the other edge of the pad section 102. This allows a user to quickly free themselves of the sleeping apparatus 100 should there be a need, such as in cases of emergency or other situations.

Referring now to FIGS. 4A through 4E, embodiments illustrate one example of how the sleeping apparatus may be manufactured. Note that in the example illustrated, seam allowances are half-inch unless otherwise specified.

Figure 4A:
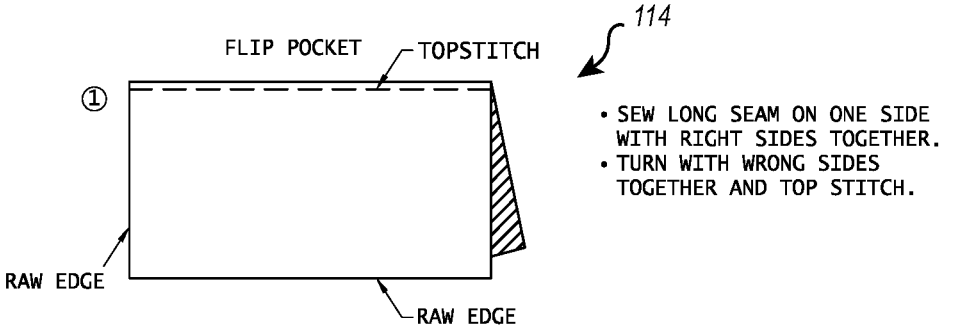

To construct the sleeping apparatus 100, the name patch 124 is sewn onto the patch pocket 122. The patch pocket 122 can then be top stitched to the pocket 114. Note that the pocket 114 can be constructed of a number of different kinds of materials, such as canvas, fleece, or other suitable materials. As illustrated in FIG. 4A, the components of the pocket 114 are sewn together with a long seam on one side with the right sides together. The wrong sides are then turned together and the pocket 114 is top stitched.

Figure 4B:
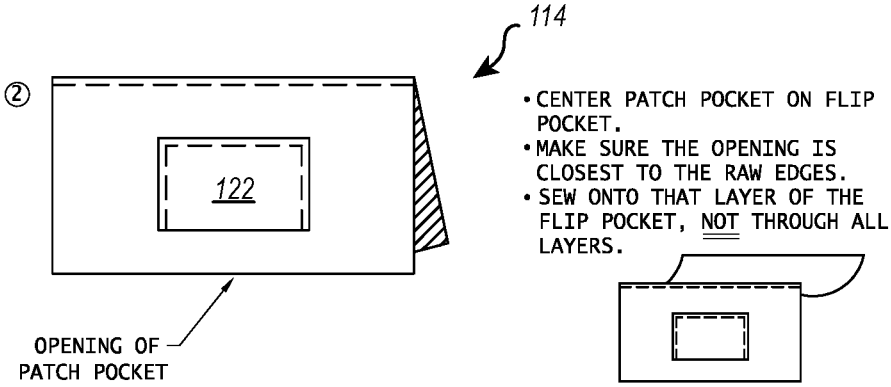

As illustrated in FIG. 4B, the patch pocket 122 is centered on the pocket 114 (or placed in another desirable positioning). Care may be taken to ensure that the opening of the patch pocket 122 is pointed towards the raw edges of the pocket 114. The patch pocket 122 is sewn on to that particular layer of the pocket 114. Care should be taken to ensure that the patch pocket 122 is not sewn through all layers of the pocket 114.

Figure 4C:
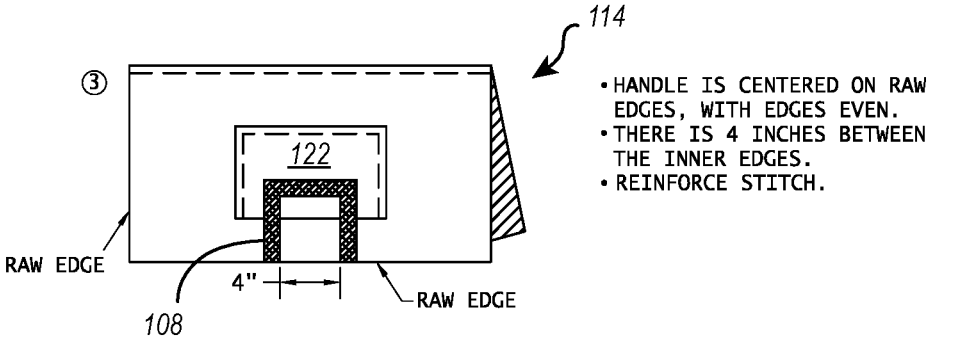

The carrying structure 108 can then be attached to the pocket 114. In the example illustrated in FIG. 4C, carrying structure 108 is centered on the raw edges of the pocket 114. Reinforcement stitching is performed as illustrated in FIG. 4C.

Figure 4D:
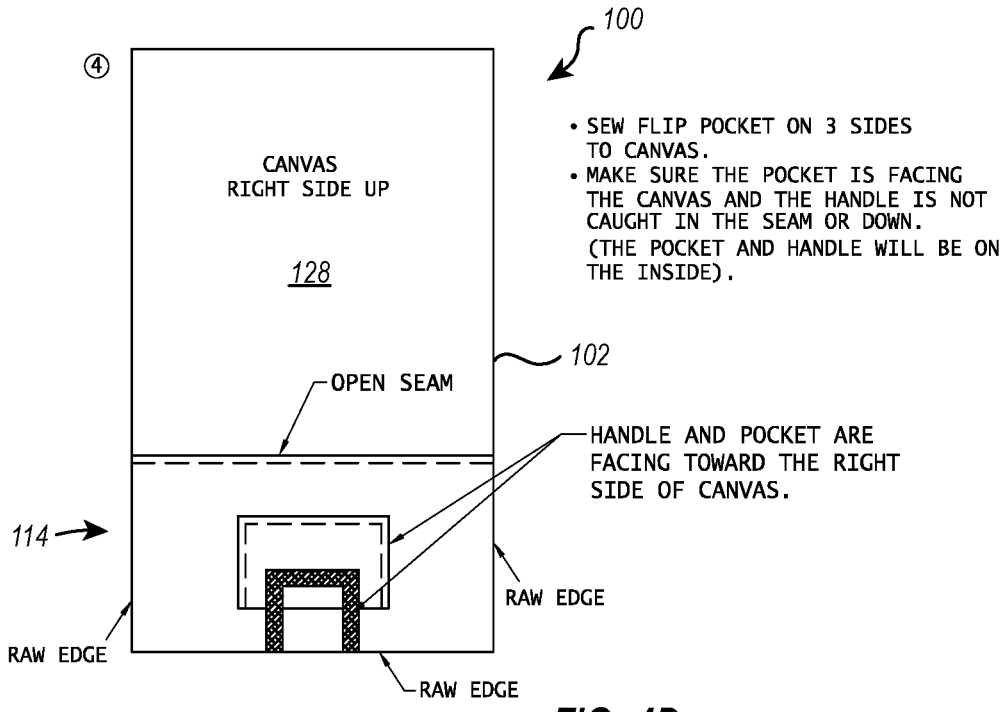

As illustrated in FIG. 4D, the pocket 114 is sewn to a first fabric portion 128 of the pad section 102 of the sleeping apparatus 100. In the illustrated example shown in FIG. 4D, the pocket 114 is sewn on 3 sides to the first fabric portion 128 of the pad section 102. Care should be taken to ensure that the opening of the pocket 114 is facing the fabric portion of the pad section 102 and that the carrying structure 108 is not caught in any seams. The pocket 114 and carrying structure 108 will be on the inside at this point. That is the carrying structure 108 and the pocket 114 are facing towards the right side of the fabric portion of the pad section 102.

Note that the first fabric portion 128 illustrated in FIG. 4D is illustrated as a canvas fabric. In particular, a canvas fabric may have durability and other desirable characteristics. In particular, the first fabric portion 128 illustrated in FIG. 4D may be the portion of the pad section 102 intended to be in contact with the ground when the sleeping apparatus 100 is in use.

Note that while canvas is illustrated in the present example, it should be appreciated that other fabrics may be used alternatively or additionally. For example, in some embodiments a waterproof fabric may be used. This may be useful if the sleeping apparatus 100 is intended to be used in a camping environment to prevent ground moisture from seeping through the sleeping apparatus 100. Alternatively or additionally, a thermally insulating fabric with a predetermined r-value may be used. For example, some embodiments may have a selected r-value of 1.5. Alternative embodiments may have an r-value selected between 1.5 and 4. Alternative embodiments may have an r-value selected between 4 and 6. Again, this may be useful as a ground break when the sleeping apparatus 100 is used in camping or other environments where the sleeping apparatus will be in contact with the ground or other materials (such as a concrete or tile floor) which may transmit cold temperatures to a user by causing heat flow from the user to the ground or other materials.

Figure 4E:
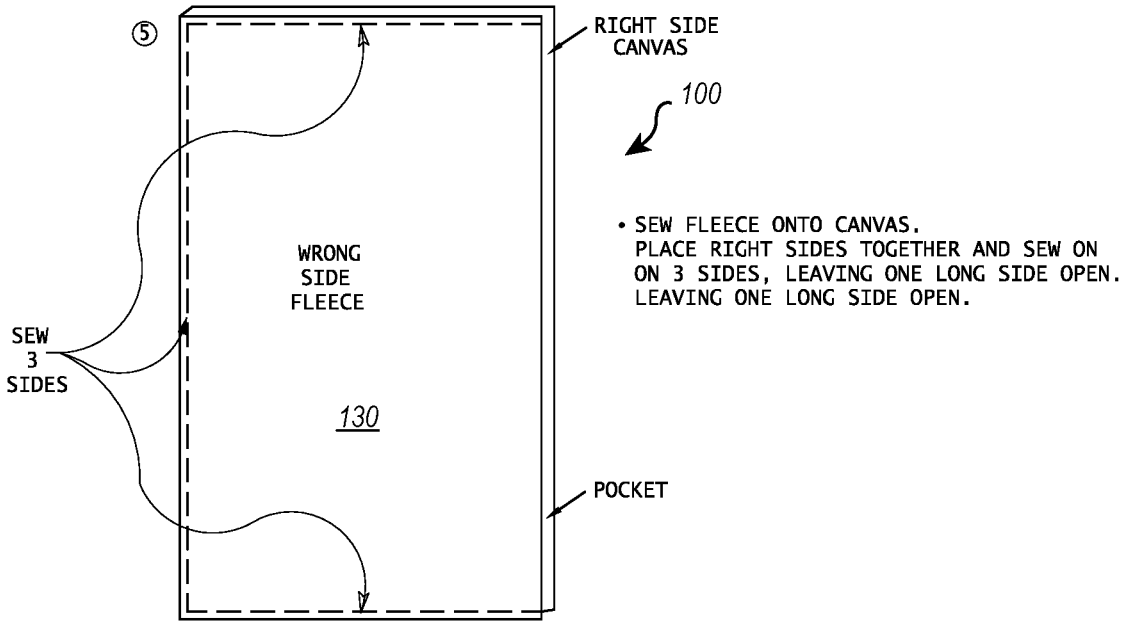

Referring now to FIG. 4D, a second fabric portion 130 is sewn to the first fabric portion 128. This is done by placing the right sides of the first fabric portion 128 together with the second fabric portion 130. The fabric portions are sewn together on 3 sides leaving one long side open as illustrated in FIG. 4E.

Note that in the illustrated example, the second fabric portion is fleece. This creates a soft sleeping surface for the user. However, it should be appreciated that other fabrics may be used alternatively or additionally. Note that in some embodiments, consideration is given to the type of fabric used based on the ability of the first fabric portion to create sufficient friction when the sleeping apparatus 100 is folded into the pocket 114 to ensure that the sleeping apparatus does not come undone from the pocket 114 when the sleeping apparatus 100 is carried such that the opening of the pocket 114 is in a downward position. Thus, embodiments may use various types of canvas, felt, fleece, or other high friction materials as compared to other materials such as fine weave silks or other fine weave materials that have less friction. Additionally, consideration may be given to the type of material used to implement the pocket 114 so as to ensure appropriate amounts of friction. In particular, the sleeping apparatus made designed such that the coefficient of static friction between the first fabric portion 128 and the material used to create the pocket 114 meets or exceeds some predetermined threshold. In this way, the material used for the pocket 114 and the first fabric portion 128 may be adjusted so long as the appropriate coefficient of static friction is met.

Referring now to FIG. 4F, construction of the blanket section 106 is illustrated. The blanket section 106 includes a sheet side fabric 132 and a blanket side fabric 134. The sheet side fabric 132 is intended to be in contact, or at least nearer to the user than the blanket side fabric 134. The blanket section 106 is constructed by sewing the sheet side fabric 132 and the blanket side fabric 134 together. This is done with right sides in on three sides of the blanket section 106. Right sides are then turned out such that there is a long side with raw edges. The raw edges of the blanket section 106 are matched to the raw edges of the pad portion 102. 102. This should be done so that the sheet side 132 lays next to the second fabric portion 130. Note that typically, the user is intended to lay on the second fabric portion 130 with the first fabric portion 128 on the ground. The blanket section 106 is then sewn to the pad section 102. In the example illustrated this sewing is done one inch from the bottom pocket edge with raw edges together.

Note that the sheet side fabric 132 and the blanket side fabric 134 may be of the same or different materials. In some embodiments, the sheet side fabric and the blanket side fabric 134 may have different designs printed or applied for decorative and aesthetic purposes. Alternatively or additionally, materials may be selected for certain functionality. For example, the sheet side fabric 132 may be a satin or other fine weave material for comfort of the user. The blanket side fabric 134 may be a material selected for certain utilitarian characteristics such as heat retention, waterproofing, or other purposes. For example, in one specialized example, the blanket fabric may comprise a reflective foil placed arranged such that body heat of the user is reflected back towards the user however, in other embodiments, materials such as fleece, felt, chambray cotton, or other appropriate materials may be used. It should be appreciated that various different materials may be selected depending on the anticipated use of the sleeping apparatus 100.

Additionally, while not illustrated here, it should be appreciated that insulating materials or other materials such as down, batting, or other materials may be placed between the sheet side fabric 132 and the blanket side fabric 134.

Note that padding material is now inserted between the first fabric portion 128 and the second fabric portion 130 to create a comfortable sleeping surface for the user. In some embodiments, the padding may be a 6-inch layer of batting. In some embodiments, more batting is placed in a portion intended to be used as the pillow portion 104. For example, in some embodiments 4 to 6 inches thickness of batting is used for the pillow portion 104 while the remaining portions of the pad portion 102 is 1½ to 2½ inches thick. However, it should be appreciated that different thicknesses may be used in alternative or additional examples. Note that in some embodiments, material selected for the other portions of the sleeping apparatus 100 may be taken into consideration when determining the thickness of the padding. In particular, as noted above, there is a desire to have a certain coefficient of static friction between the pocket 114 and other portions of the sleeping apparatus 100. The thickness of the padding is a factor in the magnitude of the coefficient of static friction. In particular, thicker padding will increase the coefficient of static friction while thinner padding will reduce the coefficient of static friction. Thus, some embodiments may make engineering decisions where padding thickness is selected based on the materials used in other portions of the sleeping apparatus 100 to ensure that an appropriate coefficient of static friction is achieved and maintained to ensure that the sleeping apparatus can be transported folded into the pocket 114, with the opening of the pocket 114 facing downward.

Note that the padding may be any one of a number of different materials including polyester fiber fill, down, or other appropriate padding.

Once the padding has been inserted into the material, raw edges are folded over ½ inch. Then, the final seam is sewn. Layers of this final seam include first fabric portion 128, the layers of the pocket 114, the second fabric portion 130, and the layers of the blanket section 106. Raw edges are folded inward and sewn shut as illustrated in FIG. 4G.

Baffles are formed by sewing or tacking the baffles in the pad section 104 to prevent the padding from migrating in the pad section 104 of the sleeping apparatus 100. This can be accomplished by sewing across the first fabric portion 128 and the second fabric portion 130, or tacking portions of the first fabric portion 128 and the second fabric portion 130.

Some additional design considerations for the particular example illustrated are now discussed. However, it should be appreciated that other embodiments may implement other dimensions and design choices. The following is simply illustrated as one particular embodiment.

The pad section 142 is constructed using fabric portions which are cut 55"×25" such that the sewn measurements are 54"×24". Baffles sections are approximately 10.6 inches.

The blanket section 106 is constructed by cutting 2 pieces of fabric that are 41"×41" such that the sewn measurements are 40"×40".

The pocket 114 is constructed using material that is cut 18"×26" such that the sewn measurements are 17"×25.

The optional decorative patch pocket is constructed from material that is 11"×11" such that the sewn measurements are 10 inches 10 inches.

The carrying structure 108 is constructed to be 2.5"×18". The carrying structure 108 includes a 1-inch cotton cord by 12 inches. In some embodiments, the carrying structure 108 further includes reinforcement such as interfacing that measures 2.5"×12".

To construct the carrying structure 108, one can fold over right sides together and sew along the long edge. The right sides are then turned out and cord material inserted. Note that the cord material will be scrunched. Interfacing is sewn to the inside of a reinforcement strip. The carrying structure 108 is then folded over and the edges are finished. On all three sides, the carrying structure is folded in half to two equally spaced 6 inch strips with 1 inch of each end of the carrying structure between the strips. The two strips and carrying structure ends are then sewn together. The carrying structure is attached to the sleeping apparatus 100 such that inner edges of a the carrying structure (in this case a handle) are 4 inches apart.

The optional name tag 126 is constructed from fabric that is 4½ inches by 5.25" is which is sewn to 4"×5".

Note that in some embodiments, fabrics for various portions of the sleeping apparatus 100 may be selected such that they can be used for flannel board functionality. In particular, some embodiments may include various selectively removable items, such as shapes, figures, and the like with friction attaching backing, such as sandpaper or hook fasteners for a hook and loop system. The items may be configured to be stored in the patch pocket 122. One of more of the fabric materials for the sleeping apparatus may comprises felt, loop fabric, and the like to allow a user to attach the selectively removable items to the fabric. Further, the fabrics may have various designs corresponding to the characteristics of the removable items. For example, if the removable items have a princess theme, the fabrics may include images of castles and the like.

The remaining Figures illustrate various aesthetic and functional features of the sleeping apparatus 100.

For example, FIG. 5 illustrates a bottom perspective view of the sleeping apparatus 100 when folded for transport.

Figure 6:
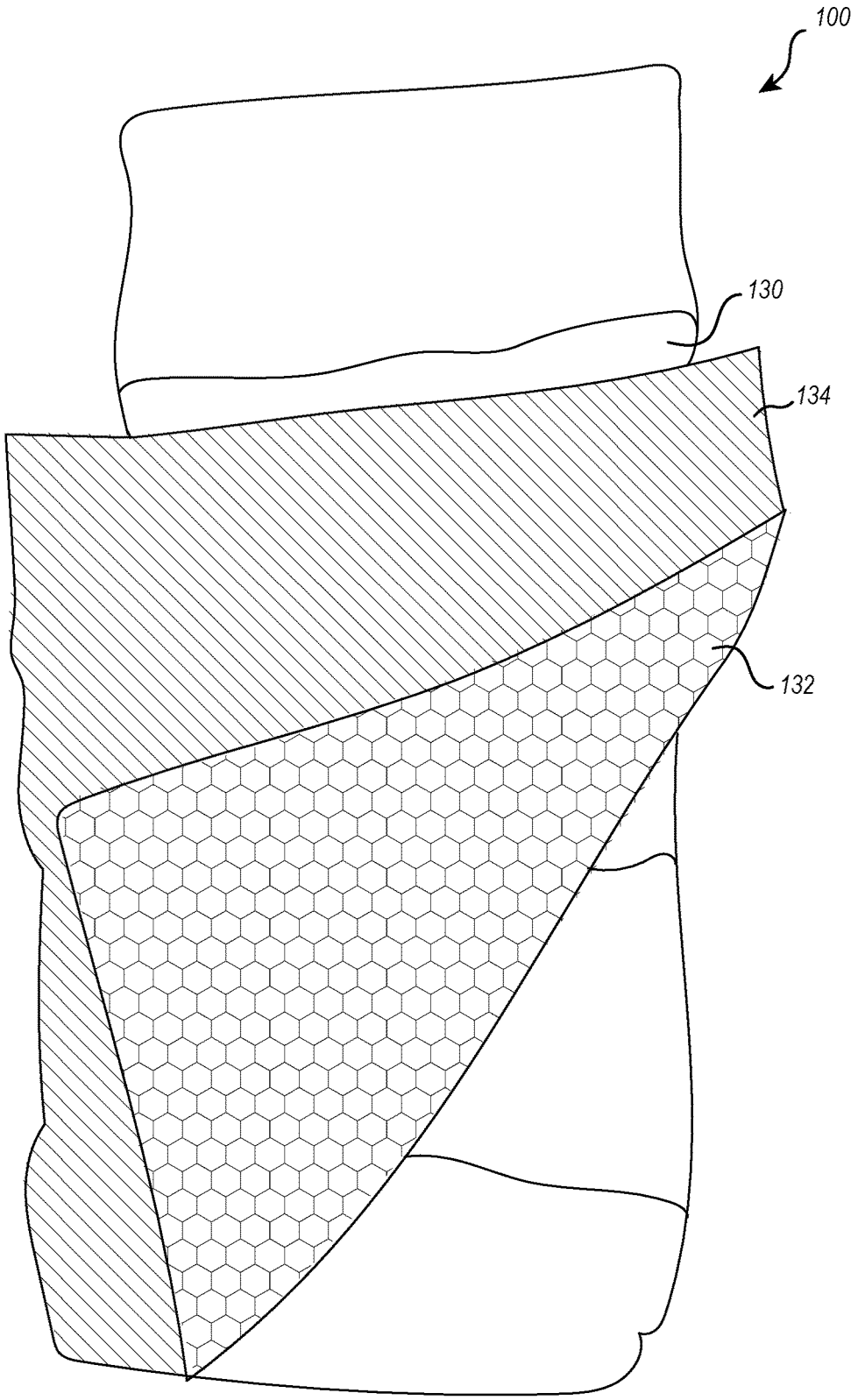
FIG. 6 illustrates a top view of a sleeping apparatus in an open position.

FIG. 6 illustrates a top view of the sleeping apparatus 100 in an open position configured for sleeping.

FIG. 7 illustrates a bottom view of the sleeping apparatus 100 in an open position configured for sleeping.

Figure 8:
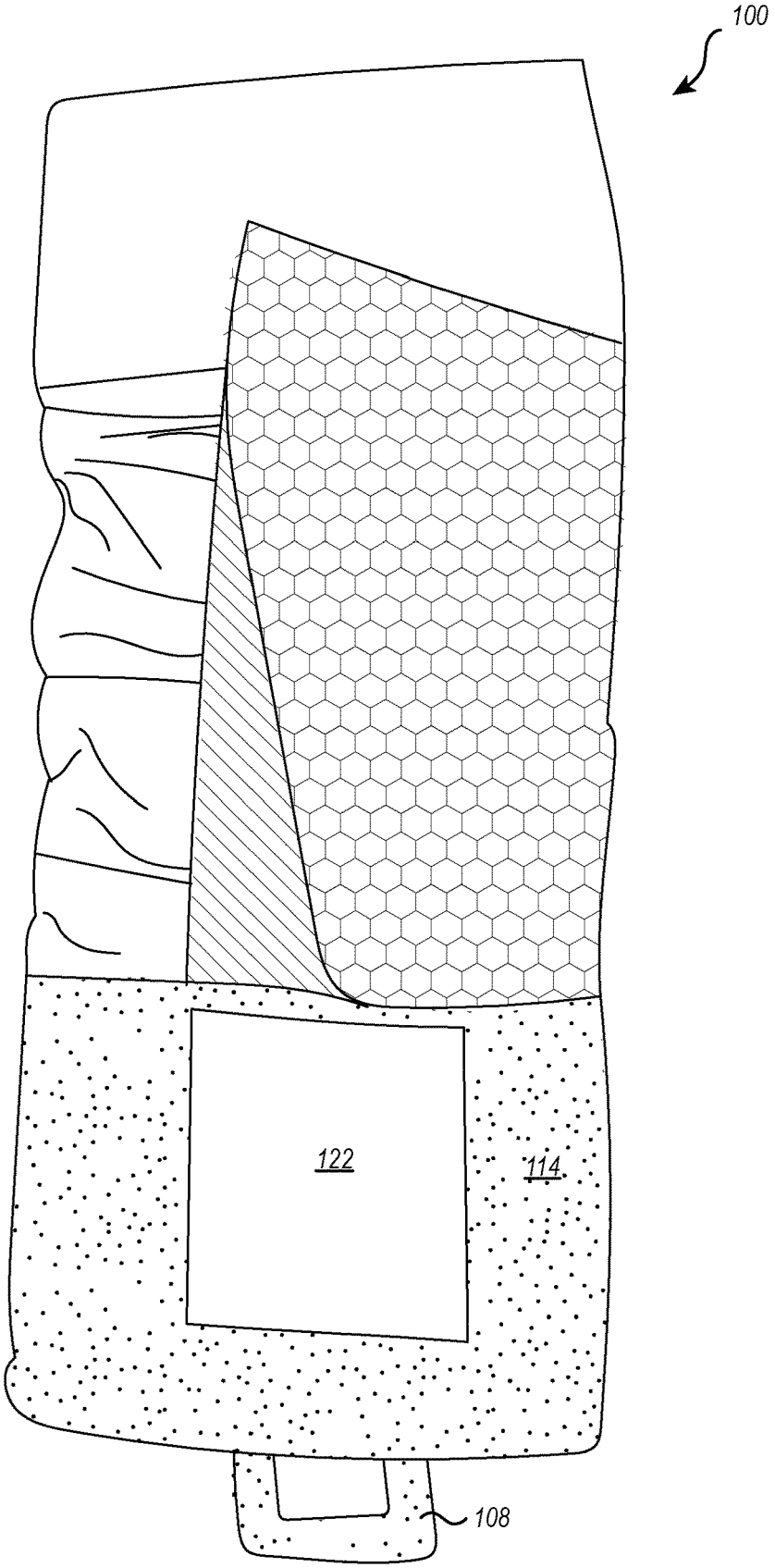
FIG. 8 illustrates a top view of a sleeping apparatus in a semi-closed position.

FIG. 8 illustrates a top view of the sleeping apparatus 100 in an semi-closed position with the pocket 114 folded onto the top of the sleeping apparatus 100 in preparation for folding or rolling the sleeping apparatus 100 into the pocket 114.

Figure 9:
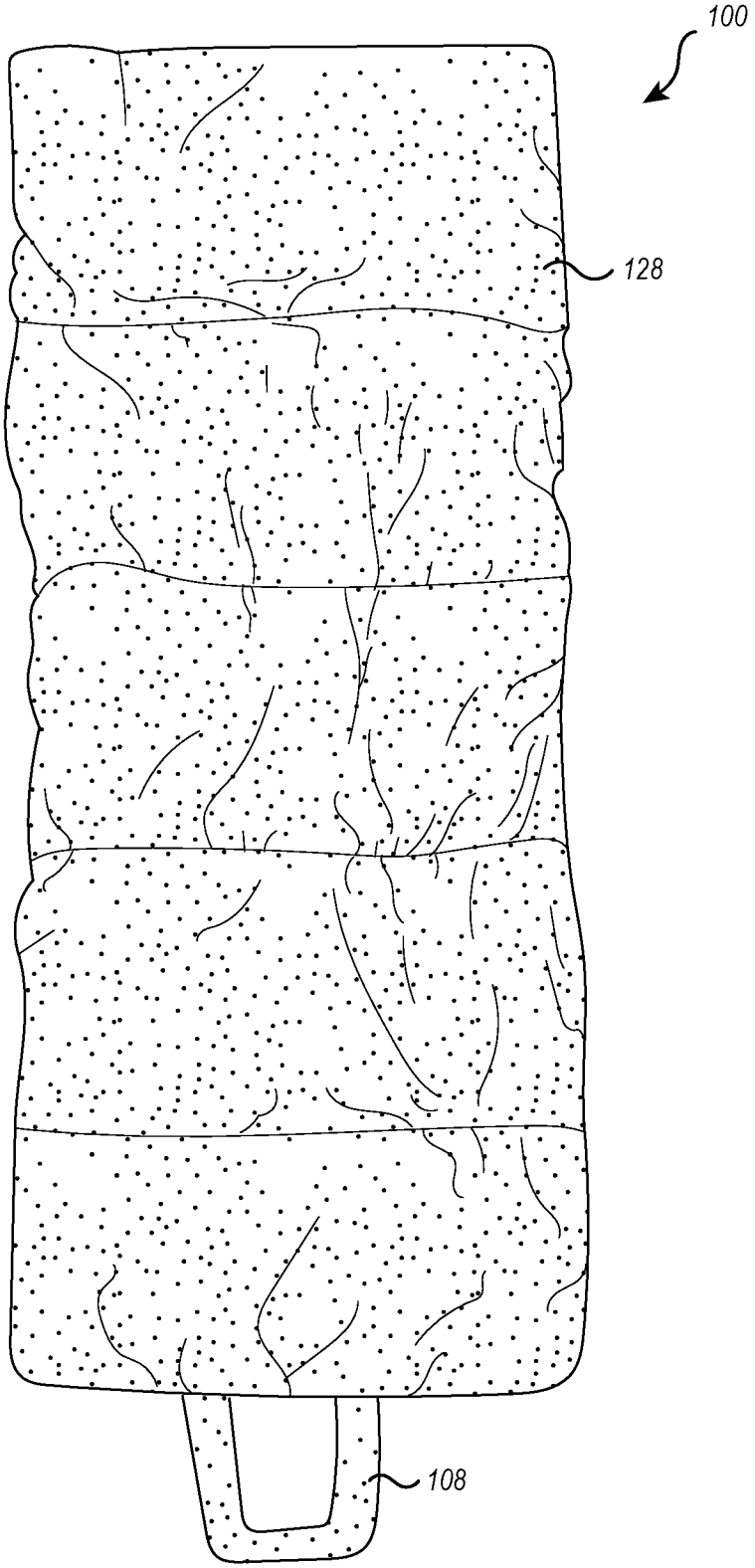
FIG. 9 illustrates a bottom view of a sleeping apparatus in a semi-closed position.

FIG. 9 illustrates a bottom view of the sleeping apparatus 100 in an semi-closed position with the pocket (not shown in this view) folded onto the top of the sleeping apparatus 100 in preparation for folding or rolling the sleeping apparatus 100 into the pocket.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sleeping apparatus comprising:

a pad section configured to allow a user to lay on the pad section, the pad section comprising padding of a predetermined thickness;

a blanket section coupled lengthwise to one side of the pad section, and configured to fold onto, and substantially cover at least a portion of the user and the pad section;

a pocket permanently coupled to the pad section, wherein the pocket comprises an opening, and wherein other portions of the sleeping apparatus are configured to fold into the pocket and be held in the pocket by friction when the opening of the pocket is in a downward position for transportation, without additional cordage to secure the other portions of the sleeping apparatus in the pocket; and a carrying structure coupled to a foot end of the sleeping apparatus, wherein the pocket is coupled to the pad section at the foot end, the pocket being configured to fold over the carrying structure when the sleeping apparatus is opened for sleeping and to be opposite, and distal the opening of the pocket.

2. The sleeping apparatus of claim 1, wherein the pocket comprises one or more objects attached onto the pocket to cause the pocket to be uncomfortable to sleep on such that a user will be motivated to place the pocket in a downward position when using the sleeping apparatus.

3. The sleeping apparatus of claim 1, wherein the carrying structure comprises a handle.

4. The sleeping apparatus of claim 1, wherein the pad section comprises a pillow portion, wherein the pillow portion includes padding that is thicker than padding in other portions of the pad section.

5. The sleeping apparatus of claim 4, wherein the pillow portion is at a head end of the pad portion and the pocket is at a foot end of the pad portion opposite the head end.

6. The sleeping apparatus of claim 5, wherein the pillow portion comprises about 6 inches thick of padding and the remainder of the pad section comprises about between 1½ to 2½ inches thick of padding.

7. The sleeping apparatus of claim 1, wherein the pad section comprises baffles to prevent the padding from migrating in the pad section.

8. The sleeping apparatus of claim 1, wherein the pad section comprises a bottom canvas fabric layer coupled to a top fleece layer.

9. The sleeping apparatus of claim 1, wherein the padding comprises batting.

10. The sleeping apparatus of claim 1, wherein one or more elements of the sleeping apparatus are configured to be used with removable shapes or figures, including shapes or figures having at least one of sandpaper or hook fasteners for use in a hook and loop fastening system.

11. A method of manufacturing a sleeping apparatus comprising:

creating a pad section configured to allow a user to lay on the pad section, the pad section comprising padding of a predetermined thickness;

attaching a blanket section coupled lengthwise to one side of the pad section, and configured to fold onto, and substantially cover at least a portion of the user and the pad section;

permanently couple a pocket to the pad section, wherein the pocket comprises an opening, and wherein other portions of the sleeping apparatus are configured to fold into the pocket and be held in the pocket by friction when the opening of the pocket is in a downward position for transportation, without additional cordage to secure the other portions of the sleeping apparatus in the pocket; and coupling a carrying structure to a foot end of the sleeping apparatus, wherein the pocket is coupled to the pad section at the foot end, the pocket being configured to fold over the carrying structure when the sleeping apparatus is opened for sleeping and to be opposite, and distal the opening of the pocket.

12. The method of claim 11, further comprising attaching more objects onto the pocket to cause the pocket to be uncomfortable to sleep on such that a user will be motivated to place the pocket in a downward position when using the sleeping apparatus.

13. The method of claim 11, wherein the carrying structure comprises a handle.

14. The method of claim 11, further comprising creating a pillow portion in the pad section, wherein the pillow portion includes padding that is thicker than padding in other portions of the pad section.

15. The method of claim 14, wherein creating the pillow portion comprises creating the pillow portion at a head end of the pad portion and wherein the pocket is disposed at a foot end of the pad portion opposite the head end.

16. The method of claim 14, wherein creating the pillow portion comprises disposing about 6 inches thick of padding in the pillow portion, and wherein the method comprises disposing about between 1½ to 2½ inches thick of padding in the rest of the pad section.

17. The method of claim 11, further comprising forming baffles in the pad section to prevent the padding from migrating in the pad section.

18. The method of claim 11, wherein creating a pad section comprises coupling a bottom canvas fabric layer to a top fleece layer.

19. The method of claim 11, wherein the padding comprises batting.

20. A method of using a sleeping apparatus comprising:

folding a blanket section of the sleeping apparatus coupled lengthwise to one side of a pad section, over the pad section;

folding the blanket section and the pad section into a pocket permanently coupled to the pad section for transportation, without additional cordage to secure the blanket section and the pad section into the pocket, wherein the pocket comprises an opening; and carrying the pocket using a carrying structure coupled to a foot end of the sleeping apparatus, with the opening of the pocket in a downward position, and other portions of the sleeping apparatus held in the pocket by friction, wherein the pocket is coupled to the pad section at the foot end, the pocket being configured to fold over the carrying structure when the sleeping apparatus is opened for sleeping and to be opposite, and distal the opening of the pocket.

* * * * *